United States Patent [19]

Arabori et al.

[11] Patent Number: 5,025,896

[45] Date of Patent: Jun. 25, 1991

[54] ELEVATOR CONTROL APPARATUS

[75] Inventors: Noboru Arabori; Hideaki Takahashi, both of Katsuta; Yoshio Sakai, Ibaraki; Masao Nakazato; Masakatsu Tanaka, both of Katsuta; Tatsuhiko Takahashi, Ibaraki; Katsutaro Masuda; Masanobu Itoh, both of Katsuta; Yuji Toda, Hitachi, all of Japan

[73] Assignee: Hitachi, Ltd., Tokyo, Japan

[21] Appl. No.: 322,913

[22] Filed: Mar. 14, 1989

[30] Foreign Application Priority Data

Mar. 18, 1988 [JP] Japan ..... 63-63341

[51] Int. Cl.[5] ..... B66B 1/28

[52] U.S. Cl. ..... 187/115

[58] Field of Search ..... 187/115

[56] References Cited

U.S. PATENT DOCUMENTS

| | | | |
|---|---|---|---|
| 3,244,957 | 4/1966 | Spiess et al. | 187/115 X |
| 3,614,996 | 10/1971 | Saito et al. | 187/115 |
| 4,739,969 | 4/1988 | Eckersley et al. | 187/115 X |
| 4,754,850 | 7/1988 | Caputo | 187/115 |

*Primary Examiner*—A. D. Pellinen
*Assistant Examiner*—W. E. Duncanson, Jr.
*Attorney, Agent, or Firm*—Antonelli, Terry, Stout & Kraus

[57] ABSTRACT

An elevator car and a counterweight is suspended on a sheave by means of a rope in a well-rope faashion. In dependence on the number of passengers on the car, the sheave is applied with an unbalance torque making appearance between the car and counterweight. Upon starting of the elevator operation by releasing a brake, upward or backward bouncing of the car takes place due to the unbalance torque. For preventing such bouncing of the car, a start compensation is performed by generating a motor torque which can cancel out the unbalance torque in precedence to the releasing of the brake. The brake is installed swingably on a winding equipment. Displacement of the brake during actuation thereof indicates the presence of the unbalance torque. By taking advantage of this displacement, the start compensation is carried out by increasing the motor torque progressively in the direction depending on the displacement and by holding the motor torque constant at a value attained when the displacement becomes smaller than a predetermined value.

34 Claims, 7 Drawing Sheets

CLOCKWISE
+Tmax
TM
TORQUE
P
TIME
TL
-Tmax
COUNTER-CLOCKWISE

ON
CAR START COMMAND
TIME

ON
OFF
SW. 10
TIME
OFF
SW. 11
TIME

TBRA
ON
OFF
BRAKE RELEASE COMMAND
TBR
Si

SPEED COMMAND
TIME

CAR SPEED
UP
UP

BRAKE
T1
TENC
ON
ON

START COMMAND
T2
TST
ON
ON

OUTPUT OF COUNTER 84
TENC
ΔPN
PN1
PN2
PN1
T3
T4

OUTPUT OF MEMORY 85
PN1

TORQUE COMMAND
T4
TIME

ELEVATOR CONTROL APPARATUS

BACKGROUND OF THE INVENTION

1. Field of the Invention

The present invention generally relates to an elevator (or lift) control apparatus and more particularly to an apparatus for performing compensation for shock which is likely to occur upon starting of the elevator car operation without resorting to the use of a car-onboard load detector 2. Description of the Prior Art Heretofore, in the conventional elevator (or lift) systems, compensation for the shock or bouncing which the elevator car (or cage) may otherwise experience upon starting of the elevator operation (hereinafter referred to as the start compensation for convenience of explanation) has generally been achieved by making use of a signal produced by a load detector installed beneath the car (i.e. car-onboard detector), as is disclosed in Japanese Patent Application Laid-Open No. 149040/1975 (JP-A-50-149040) and Japanese Patent publication No. 2275/1975.

It is also known that the start compensation is effectuated by detecting an unbalance torque applied to a brake apparatus without using the car-onboard load detector. For particulars, reference may be made, for example, to JP-A-62-56277 and JP-A-62-116478.

Further, there is disclosed in JP-A-57-1180 a start compensation system in which a brake apparatus is provided with a brake shoe which is displaceable relative to a stationary structural member of an elevator machine house, wherein the unbalance torque is detected on the basis of the displacement of the shoe to be utilized for the elevator control.

In the technical field of the disc (or disk) brake, it is known to mount displaceably a stationary disc of the disc brake on a bracket of a base structure, wherein displacement of the stationary disc is detected by a switch adapted for detecting the actuated state of the brake, as is disclosed in JP-A-58-109741.

In the case of the conventional elevator start compensation apparatus exemplified by the one disclosed in the JP-A-62-56277, the unbalance torque applied to the brake unit is detected by a torque sensor, wherein the start compensation is performed in dependence on a detected value derived from the output of the torque sensor. To this end, it is required that the torque sensor must be able to produce the output continuously and linearly as a function of the unbalance torque. Besides, the requirement imposed on the torque sensor presents a direct influential factor for the satisfactory elevator start compensation.

Such being the circumstances, the control system inclusive of the torque sensor is necessarily very complicated and expensive, which is a disadvantage.

SUMMARY OF THE INVENTION

It is therefore an object of the present invention to provide an elevator control apparatus capable of realizing start compensation satisfactorily with a control apparatus of simplified structure.

In view of the above and other objects which will be apparent as the description proceeds, it is an aspect of the present invention that a brake apparatus for holding stationarily an elevator car regardless of an unbalance torque produced due to difference in weight between the car and a counterweight is rotatably or swingably supported by elastic or resilient means relative to a shaft of an electric motor for driving the elevator car, wherein upon starting of the elevator operation, a torque for cancelling out the unbalance torque is so produced by the electric motor as to be increased progressibly in dependence on the direction of the displacement of the brake apparatus in the state in which the brake is still operative and that the torque of the electric motor is held constant at a value attained when the displacement of the brake apparatus becomes smaller than a predetermined value or more preferably when the displacement becomes zero.

During the period in which the elevator car is stopped, the unbalance torque due to the difference in weight between the car and the counterweight is borne by the brake apparatus. By releasing the brake apparatus upon starting of the elevator operation in the state where the unbalance torque coincides with the torque generated by the electric motor, no shock (bounce) of the car can take place.

In the conventional elevator system in which the car-onboard load (i.e. load on the elevator car) is detected for determining the unbalance torque, not only is the structure of the car complex but also means for transmitting the load signal to the machine house must be provided.

In the hitherto known elevator system in which a worm gear train is employed as a speed reduction gear transmission, efficiency in transmitting a torque in the reverse direction to the electric motor through the reduction gears from the car or the counterweight by way of a suspension rope and a sheave is remarkably low when compared with the efficiency in transmitting the motor torque forwardly to the sheave and the rope and hence to the car and the counterweight through the reduction gear train. Consequently, detection of the unbalance torque at the location of the motor shaft is attended with poor accuracy.

In this regard, it is noted that the efficiency in torque transmission in the reverse direction mentioned above can be drastically improved when a parallel-shaft reduction gear transmission is employed. In that case, the unbalance torque can of course be detected with a correspondingly improved accuracy even on the side of the motor shaft.

Accordingly, by adopting such an arrangement in which the brake apparatus coupled to the motor shaft can be displaced relative to a stationary structural member of the machine house, the unbalance torque can be detected in terms of the displacement of the brake apparatus. However, even in that case, complication and high cost will be involved in realizing the torque sensor to be provided in combination with the brake apparatus such that the torque sensor has a continuous and linear characteristic for the unbalance torque.

Under the circumstances, according to a preferred embodiment of the present invention, there is proposed an electric apparatus which is combined with the torque sensor installed on the brake apparatus and which is so arranged as to detect the direction of the unbalance torque as well as the state where the magnitude of the unbalance torque applied to the brake apparatus becomes smaller than a predetermined value. In dependence on the detected direction of the unbalance torque, the motor torque is progressively increased in the direction in which the unbalance torque can be cancelled out in the state where the brake apparatus is actuated. The unbalance torque applied to the brake apparatus is thus decreased progressively. When it is detected that the unbalance torque becomes smaller than a predetermined value, the motor torque is held constant at a value attained at that time point.

By virtue of the arrangement described above, the torque sensor and the electric apparatus can be implemented in an extremely simplified structure and nevertheless make available the motor torque for the start compensation of the elevator car, making it possible to start the car smoothly and comfortably.

The torque sensor can sense the direction of the unbalance torque on the basis of the direction of displacement of the brake apparatus and detect the decrease in the unbalance torque applied to the brake apparatus below the predetermined value by taking advantage of the fact that the displacement becomes smaller than a predetermined value.

For making at least a part of the brake apparatus displaceable, it is preferred to support it resiliently. It should however be mentioned that the aimed performance can also be accomplished simply by providing a gap to allow the displacement of the brake apparatus.

By selecting a permissible range of the displacement so as to fall within a permissible range of car landing tolerance, detection of the displacement can be realized with a significantly high accuracy when compared with the detection by means of a strain gauge or the like.

DESCRIPTION OF THE PREFERRED EMBODIMENTS

Now, the present invention will be described in detail in conjunction with preferred and exemplary embodiments thereof by reference to the accompanying drawings.

Figure 1:
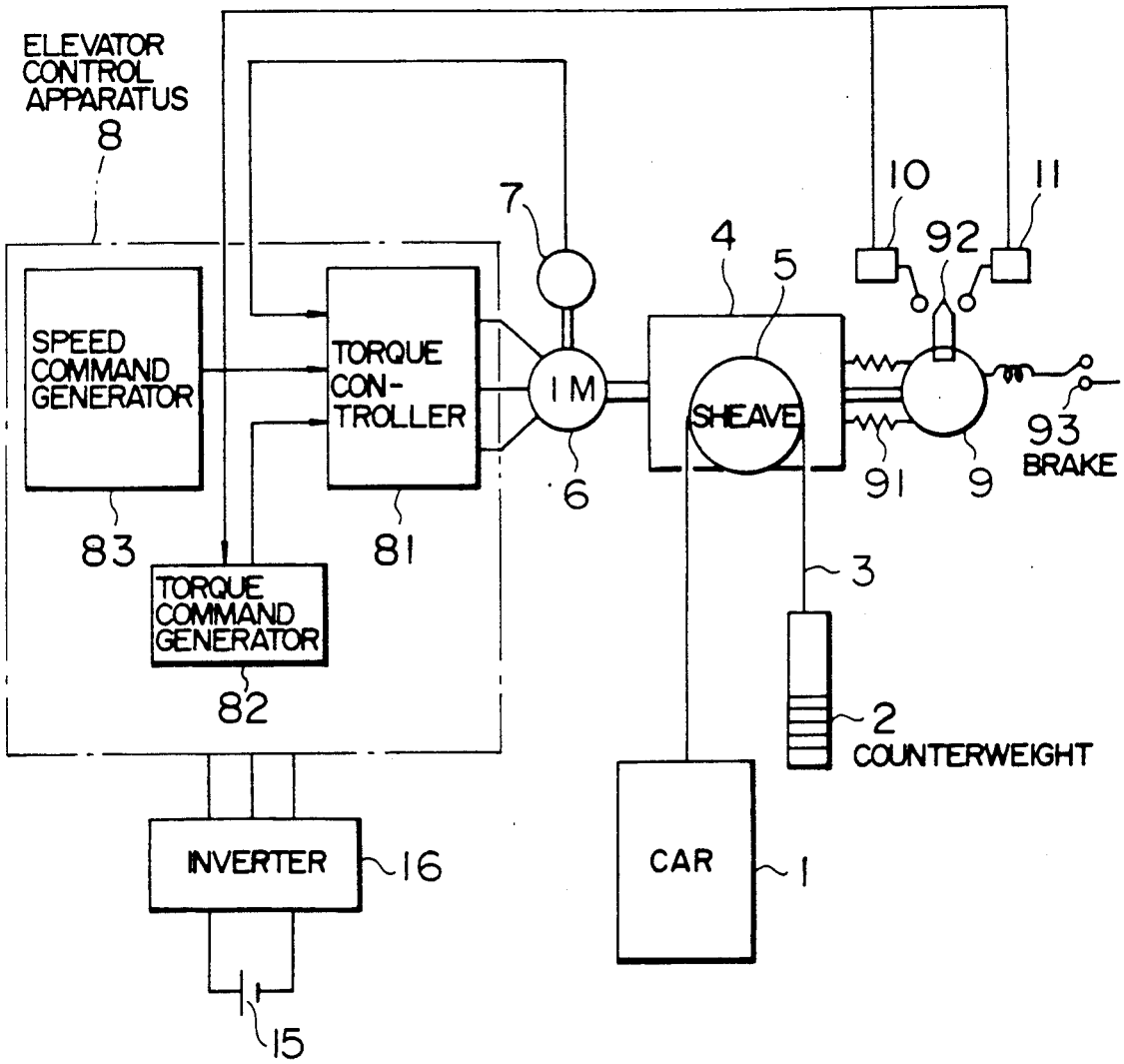
FIG. 1 is a schematic diagram showing a general arrangement of an elevator system provided with a control apparatus according to a first embodiment of the present invention.

FIGS. 1 to 4 show a first embodiment of the present invention, in which FIG. 1 shows a general arrangement of an elevator system equipped with a control apparatus according to a first embodiment of the invention.

Referring to FIG. 1, an elevator car 1 and a counterweight 2 are connected to each other through a rope 3 and disposed in a well-rope like fashion by way of a sheave 5 constituting a part of a winding machine 4 which has a driven or input shaft coupled to a driving electric motor 6. This motor 6 may be a DC motor, an induction motor or a synchronous motor. In the case of the illustrated embodiment, it is assumed that the drive motor 6 is constituted by a three-phase induction motor (IM). The winding machine or equipment comprises a parallel axis type reduction gear transmission having an output shaft extending in parallel with the shaft of the electric motor 6.

Coupled directly to the shaft of the drive motor 6 is a rotary pulse encoder 7, the output signal of which is inputted to a torque controller 81 constituting a part of the elevator control apparatus 8.

On the other hand, a brake apparatus generally denoted by a numeral 9 and serving for holding the elevator car is mounted on a stationary structural member of a machine house such as, for example, the winding machine 4 by means of elastic members generally denoted by 91. In the actuated state of the brake apparatus 9, the elastic members 91 experience deformation a little under an unbalance torque produced due to difference in weight between the car 1 and the counterweight 2. In other words, the brake apparatus 9 is displaced angularly relative to the winding equipment 4 under the influence of the unbalance torque. At that time, a projecting member 92 of the brake apparatus 9 is also rotated in the same direction as the latter. Supported fixedly on the winding machine 4 are a pair of micro-switches 10 and 11 which are so disposed as to be selectively actuated by the projecting member 92 mentioned above. More specifically, assuming that the car 1 is of a greater weight than the counterweight 2, the elastic members 9 are angularly displaced or deformed due to the prevailing unbalance torque, as the result of which the brake apparatus 9 is also angularly displaced in the counterclockwise direction, whereby the projecting member 92 is brought into contact with the micro-switch 10 which is thus closed. Reversely, in the case where the counterweight 2 is heavier than the car 1, the brake apparatus 9 is angularly displaced clockwise, resulting in that the micro-switch 11 is closed (ON). On the other hand, in the balanced load state where the car 1 is in balance with the counterweight 2, no angular displacement of the brake apparatus 9 takes place. Consequently, both the micro-switches 10 and 11 remain in the open state (OFF).

As will be seen from the above, the direction of the unbalance torque between the car 1 and the counterweight 2 can be detected with the aid of the micro-switches 10 and 11. Besides, the state in which the motor torque is in balance with the abovementioned unbalance torque can be detected on the basis of the inoperative state of both the micro-switches 10 and 11. The results of such detection can be advantageously utilized for the start compensation performed upon starting of the elevator car, as will hereinafter be described in detail.

Now, let's suppose, by way of example, that the car 1 is of a greater weight than the counterweight 2. In that case, the brake apparatus 9 is angularly displaced a little in the counterclockwise direction, whereby the micro-switch 10 is closed (ON) with the micro-switch 11 being off. When an elevator start command is issued in this state, a torque command generating unit 82 then produces a torque command for a torque of the clockwise direction which increases gradually or progressively from zero in the state where the brake apparatus 9 is continuously actuated. The torque command as generated is supplied to a torque controller 81 which is constituted by an inverter implemented based on the vector control concept well known in the art and controls the torque generated by the electric motor 6 in accordance with the torque command. Eventually, the torque generated by the electric motor 6 approaches the level which is balanced with the unbalance torque applied to the elevator car. Correspondingly, the magnitude of displacement of the elastic member 91 becomes approximately zero with the angular displacement of the brake apparatus being reduced to zero. During this phase, the signals of the micro-switches 10 and 11 are being inputted to the torque command generating unit 82. At the time point when the signals of both the micro-switches 10 and 11 become off, the torque command is held such that the torque generated by the electric motor 6 can be held constant at a value increased till that time point.

When the torque command is held or when both the micro-switches 10 and 11 are opened (OFF) in this manner, shock or bounce can no more occur upon starting of the elevator car which is triggered by closing a contact 93 for energizing brake coils of the brake apparatus 9 to thereby release the latter, since the torque generated by the electric motor 6 is now in balance with the unbalance torque applied to the elevator car. At this time point, a speed command generating unit 83 issues a speed command $S_i$ to move the elevator car upwardly or downwardly through the torque controller 81.

Figures 2A, 2B, 2C, 2D, 2E:
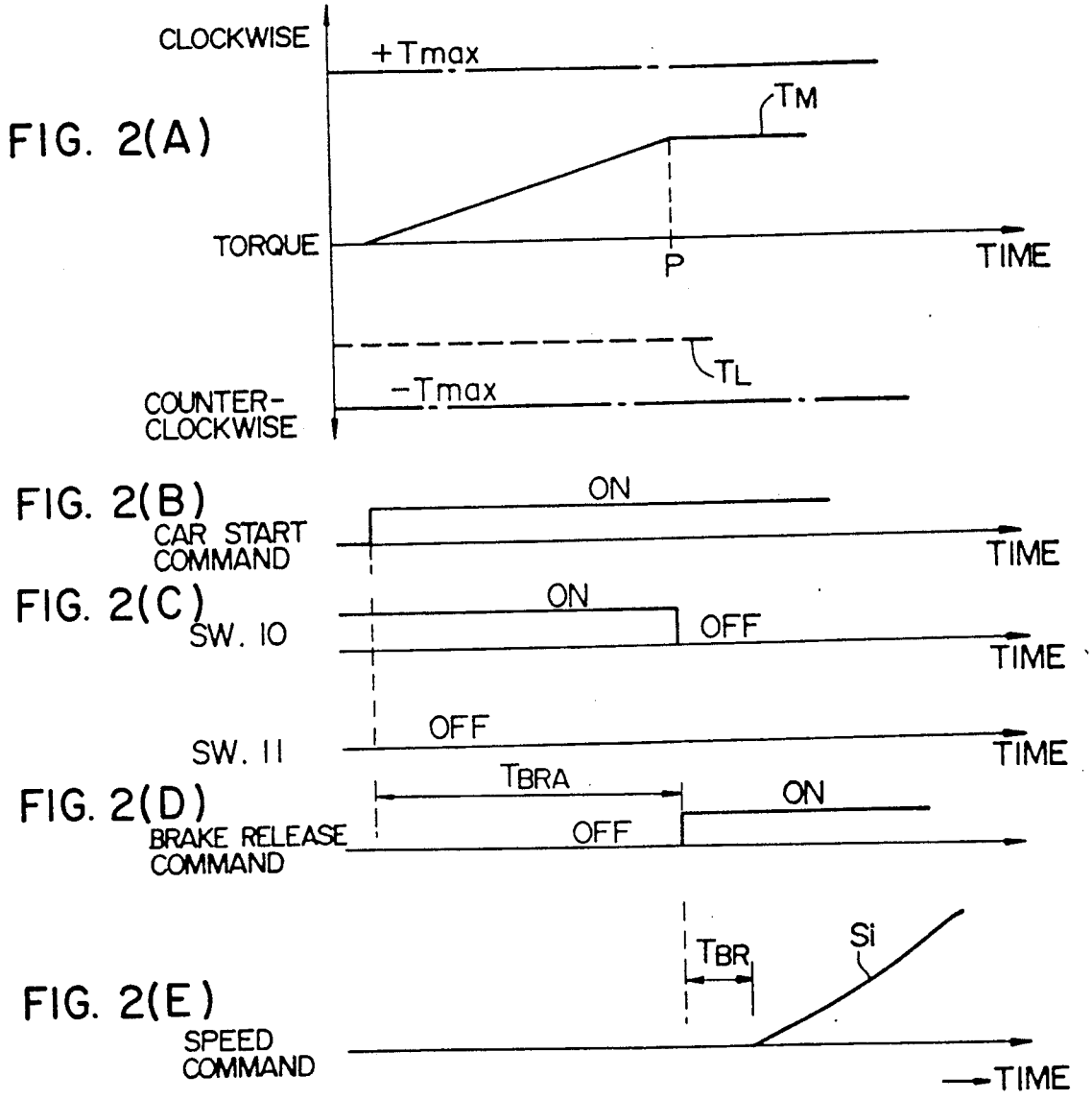
FIGS 2A–2E as time charts for illustrating operation of the elevator system shown in FIG. 1.

FIG. 2 is a view to illustrate in a time chart the operation sequence described above.

On the assumption that the elevator car 1 is heavier than the counterweight 2, the brake unit 9 is angularly displaced counterclockwise to close the micro-switch 10 while leaving the micro-switch 11 in the off state. When the elevator car start command is issued (ON), as shown in FIG. 2 at (b), it is decided by the torque command generating unit 82 on the basis of the signals of the micro-switches 10 and 11 that torque of the direction opposite to that of the unbalance torque being applied to the elevator car (i.e. the torque of the clockwise direction) must be generated. Thus, the torque command generating unit 82 generates the clockwise torque command of magnitude increasing progressively, as is shown in FIG. 2 at (a). The torque command generating unit can generate selectively either one of the torque commands of the clockwise and counterclockwise directions, wherein torque limits $+T_{max}$ and $-T_{max}$ are provided for both the torque Commands, respectively, as can be seen in FIG. 2 at (a). parenthetically, the torque command of the counterclockwise direction must be issued when the micro-switch 11 is closed.

In accordance with the torque command, the torque $T_M$ generated by the electric motor 6 is progressively increased to reach eventually a point P at which the motor torque $T_M$ is balanced with the unbalance torque $T_L$, whereupon the micro-switch 10 is opened (OFF), as shown in FIG. 2 at (c). In response to the opening (OFF-signal) of the micro-switch 10, the torque command is held constant at a value corresponding to the value of the motor tOrque $T_M$ attained at the point P, while the contact 93 for exciting the brake coils is closed (ON) to thereby release the brake, as shown at (d). In this conjunction, it should be noted that the brake release command may be issued when the micro-switch 10 or 11 is opened (OFF) or immediately after the motor torque $T_M$ has been held at the constant value. As a further alternative, the brake release command may be issued (ON) after the lapse of a time period $T_{BRA}$ which is set lOng enough for the motor torque $T_M$ to balance with a rated load of the elevator car after the elevator start command has been issued (see FIG. 2, (d)).

When the speed command Si is issued by the speed command generating unit 83, operation of the elevator car is started through the torque controller 81 (see FIG. 2 at (e)). In this conjunction, it should be noted that the speed command Si is issued with a predetermined time lag in consideration of a delay $T_{BR}$ involved in the mechanical operation of the brake.

In connection with the system arrangement shown in FIG. 1, it should be added that the speed command generating unit 83 and the torque command generating unit 82 can be implemented in terms of software capable of running on a microcomputer within the skill of the routineer in this technical field. Accordingly, further description of these units 82 and 83 will be unnecessary.

Further, in conjunction with the starting of the elevator system, it is expected that the so-called starting shock may take place due to difference between static friction and dynamic friction of the car and/or winding machine in addition to the unbalance torque mentioned above. For taking into account the shock of this kind, such an arrangement may be adopted in which a corresponding compensation is effectuated for the motor torque $T_M$ which has been balanced with the unbalanced torque $T_L$. In other words, it is possible to further mitigate the start shock by adding or subtracting a predetermined bias value to or from the motor torque $T_M$ after the point P shown in FIG. 2 at (a) has been attained. Further, the bias value may be variable or applied only for a predetermined duration to thereby exclude overshoot or the like undesirable phenomena.

Figure 3:
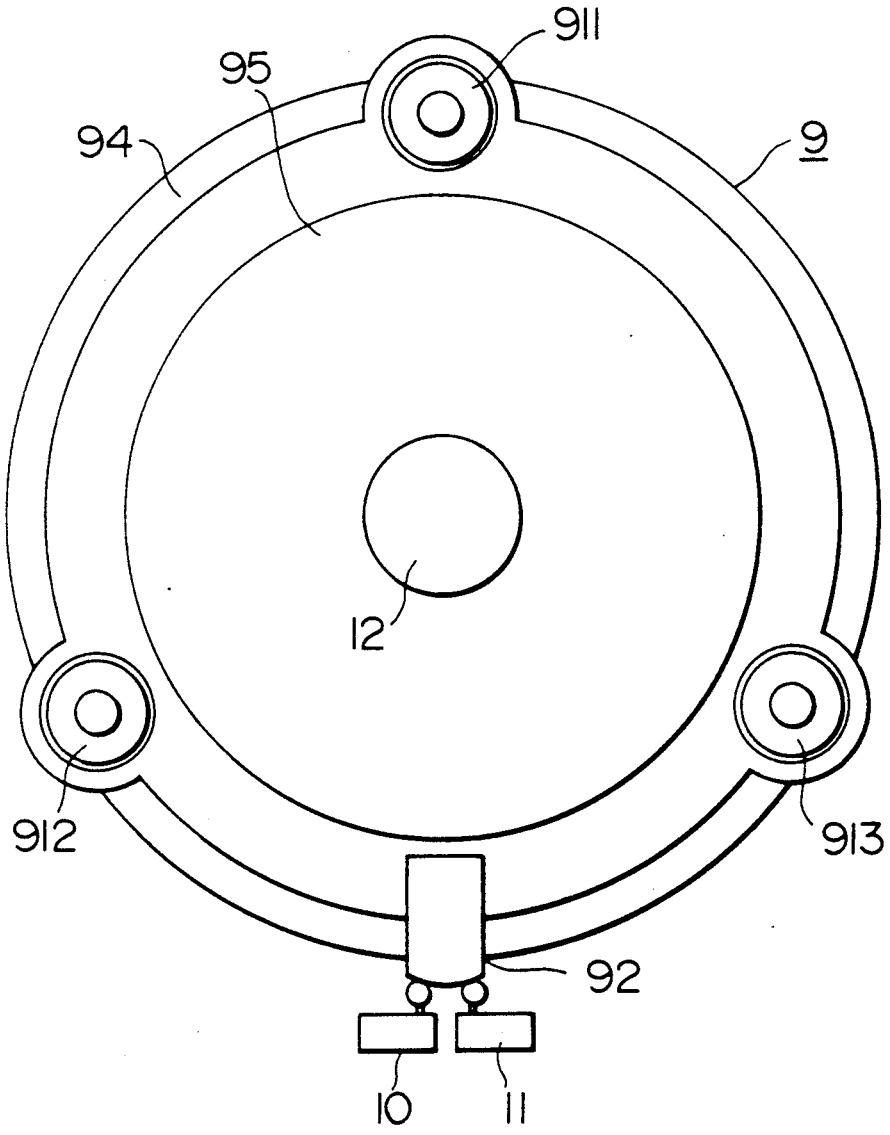
FIG. 3 is a front view of a brake apparatus which can be employed in the elevator system.

FIG. 3 is a front view of the brake apparatus 9 shown in FIG. 1. The brake apparatus 9 is coupled through the interposed elastic members such as rubber members 911 to 913 to a member 94 secured fixedly to the winding equipment 4 and includes a brake member 95 which incorporates therein coils 961 and 962, springs 97 (only one is shown), a spline 98, a lining 99 and others to serve as a disk brake well known in the art (also refer to FIG. 4). Further, the brake member 95 is provided with the projection 92. The unbalance torque due to difference in the weight between the elevator car and the counterweight is prevented from being transmitted to the shaft 12 of the winding equipment through the brake member 95 by virtue of such arrangement that the rubber members 911, 912 and 913 are resiliently deformed so that the brake member 95 is angularly displaced relative to the stationary member 94 (a structural member of the machine house). Consequently, also the projection 92 undergoes a corresponding angular displacement to contact selectively either the micro-switch 10 or 11, both being installed on the stationary member 94 or the winding equipment, whereby the micro-switches 10 and 11 are selectively closed and opened. In this manner, there can be obtained the signal indicating the direction of the unbalance torque, which signal can also be utilized for confirming the balanced state in succession to the start compensation.

Figure 4:
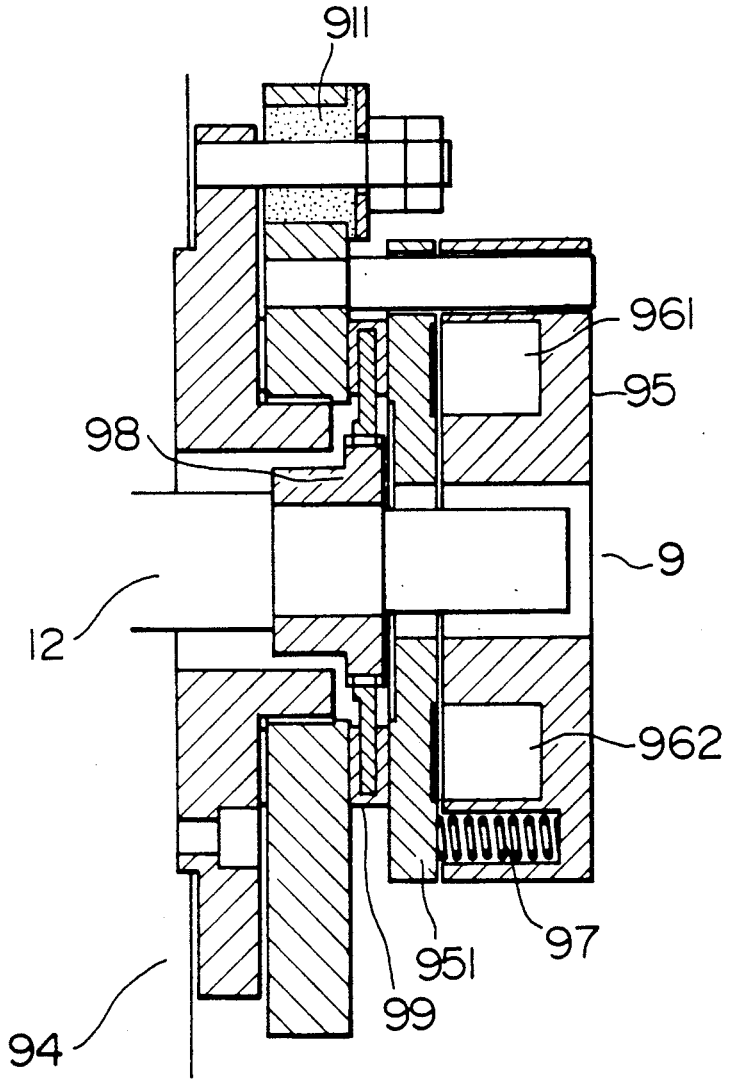
FIG. 4 is a sectional view of the brake apparatus.

FIG. 4 is a sectional view of the brake apparatus 9 shown in FIG. 3. The brake member 95 is so implemented that upon stoppage of the elevator car, the movable member 951 is pressed against the lining 99 under the force of the springs 97 to thereby hold stationarily the elevator car with a frictional force acting between the movable member 951 and the lining 99. On the other hand, when the coils 961 and 962 are electrically energized, the movable member 951 is magnetically attracted against the force of the springs 97, whereby the brake is released to allow the elevator car to be operated.

In the case of the illustrated embodiment, the brake apparatus 9 is directly coupled to the shaft of the winding equipment 4. It should however be understood that the brake apparatus 9 may be interposed between the winding equipment 4 and the electric motor 6 or on the side of the motor opposite to the winding mechanism to substantially same effect.

Further, instead of mounting resiliently the brake apparatus onto the machine house structural member through interposition of the elastic member, it is equally possible to provide simply a small gap between the stationary structural member and the brake apparatus so that the latter can be angularly displaced relative to the former. With this structure, the direction of the unbalance torque as well as the balanced state after the start compensation can be detected.

With the embodiment as well as versions thereof described above, the torque compensation at the start of the elevator operation can be realized accurately and inexpensively. Besides, the compensation for the weight of the rope is rendered unnecessary.

Figure 5:
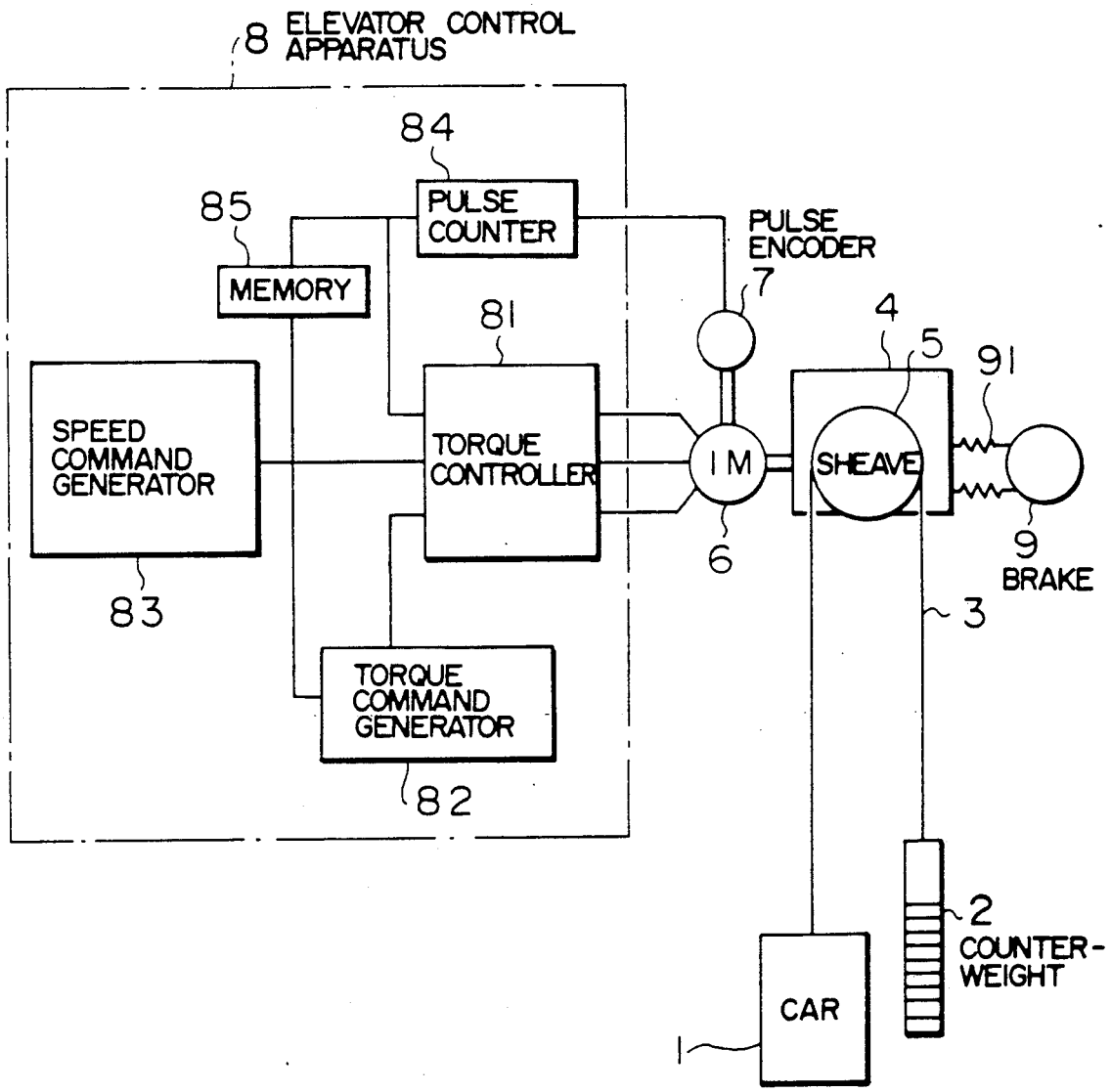
FIG. 5 is a schematic diagram showing a general arrangement of an elevator system provided with the control apparatus according to a second embodiment of the invention.
Figures 6A, 6B, 6C, 6D, 6E, 6F:
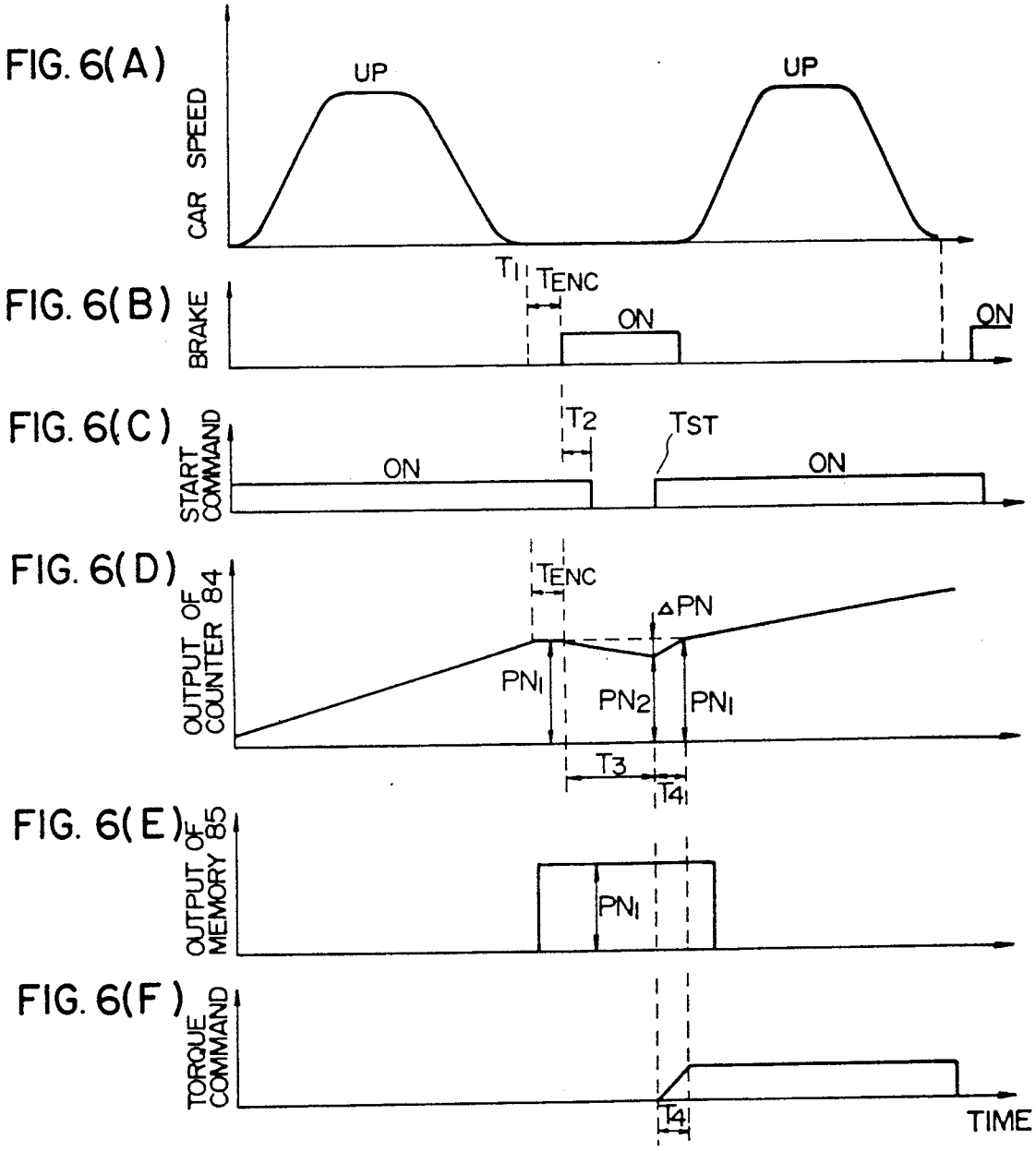
FIG. 6A–6F are time charts for illustrating operation of the elevator system shown in FIG. 5.

A second embodiment of the present invention will be described by reference to FIGS. 5 and 6, in which FIG. 5 is a diagram showing a general arrangement of the elevator system equipped with a control apparatus according to the second embodiment of the invention and FIG. 6 is a time chart for illustrating the operation of the system. As in the case of the elevator system shown in FIG. 1, the brake apparatus 9 for holding stationarily the elevator car is resiliently supported or mounted on a structural member of the machine house such as, for example, the winding equipment 4 by means of the elastic members 91. However, the brake apparatus 9 shown in FIG. 5 differs from the one shown in FIG. 1 in that neither the projecting member nor the micro-switches are provided. Instead, a pulse counter 84 is provided and connected to the output of the pulse encoder 7, wherein the output of the pulse counter 84 is connected to the torque controller 81 and a memory 85 adapted for storing the pulse number. As is well known in the art, in most of the modern elevator systems, a microcomputer is employed for the purpose of detecting the car position by accumulating the pulses generated by a pulse generator such as the pulse encoder 7 in accordance with the rotation of the electric motor or the running of the car and/or for detection of the car speed by measuring the pulse number for a unit time. The encoder 7 is provided for realizing the operations mentioned just above. Further, it is intended with the instant embodiment of the invention to make use of the pulse count output of the encoder 7 for the start compensation.

Referring to FIG. 6 illustrating in a time chart the operation for the start compensation by using the encoder 7, an elevator speed characteristic is shown al (a). At a time point $T_1$ at which the elevator car stops running, the brake still remains in the released state. Consequently, there exists a short period $T_{ENC}$ during which the unbalance torque of the elevator dynamic system is borne by the motor torque of the electric motor 6, as can be seen in FIG. 6 at (b) which shows the timing of the brake operation. During a period ON shown at (b) in FIG. 6, the brake apparatus 9 operates to generate a braking force for thereby holding the elevator car stationary. The output of the counter 84 for counting the pulses produced by the encoder 7 is shown at (d) in FIG. 6. As will be seen, the output of the counter 84 varies in dependence on the running states of the elevator car to indicate the current position thereof. Assuming that the pulse count value is PN1 at a time point $T_1$, this count value PN1 is maintained constant during the period $T_{ENC}$ for which the car is held stationary by the motor torque, as mentioned above, because the pulse number does not change during this period $T_{ENC}$. The period $T_{ENC}$ is terminated at the time point when the elevator car is held under the braking action of the brake apparatus. By taking advantage of this period $T_{ENC}$, the pulse number PN1 is stored in a pulse number storing memory (usually constituted by a random access memory or RAM) 85. In this conjunction, the memory 85 should preferably be backed up by a battery to thereby realize a non-volatile memory of which contents can be protected against volatilization even upon interruption of service. The storage of the pulse number PN1 in the memory 85 is illustrated in FIG. 6 at (e). When passengers get off and on after the brake apparatus is actuated with the door being opened, the intra-car load varies correspondingly, resulting in the elastic members 911 to 913 being deformed to allow the brake apparatus 9 to be angularly displaced. Since the motor shaft is coupled to the brake shaft, the former is rotated. As the result, the encoder 7 generates pulses. This phase takes place during a period $T_3$ shown in FIG. 6 at (d). In the case of the illustrated example, it is assumed that the brake apparatus is displaced in the direction in which the pulse count value is decreased, i.e. in the down direction of the car, which means that the intra-car load is increased when compared with the car load at the preceding landing. Thus, the pulse count value of the encoder 7 assumes PN2 immediately before the Start command $T_{ST}$ is issued in response to a new call, as shown in FIG. 6 at (c). In other words, the pulse count value of the encoder 7 is decreased by $\Delta PN$ from the value at the time of the stop.

When the start command is issued, as shown by TsT in FIG. 6 at (c), the torque command generating unit 82 reads out the pulse number PN1 stored in the memory 85 at the last time the elevator was stopped while reading out the current pulse number PN2 from the pulse counter 84 to thereby determine the direction of the torque to be applied in dependence on the result of the comparison between the pulse numbers PN1 and PN2. Since it is assumed that PN1>PN2, the torque to be applied is of the upward direction. Thus, there is issued the motor torque command for the start compensation whose value is progressively increased, as is shown in FIG. 6 at (f). As the motor torque command value is increased progressively, the electric motor 6 is rotated bit by bit. At the instant the pulse counter 84 has reached the content PN1 stored in the memory 85, i.e. when balance has been established between the unbalanced torque and the motor torque, the torque command value at that instant is held, whereupon the start compensation is completed. As described hereinbefore in conjunction with the preceding embodiment, the torque command value can be adjusted by addition or subtraction of the bias value. In response to a signal indicating the completion of the start compensation, the coils of the brake apparatus 9 are electrically energized to release the brake and at the same time the speed command is issued to operate the elevator car in the up direction. In this conjunction, it should be understood that, instead of detecting the balanced state mentioned above, the period $T_4$ shown at (d) in FIG. 6 may be set long enough for the number of pulses output from the encoder 7 to approach or take the value attained at the time of the preceding stop or landing, wherein the brake release command is validated upon lapse of the duration $T_4$ after the start command was issued. According to the second embodiment of the present invention described above, the elevator control can further be improved in respect to the reliability without need for the use of the micro-switches and other additional devices.

Figure 7:
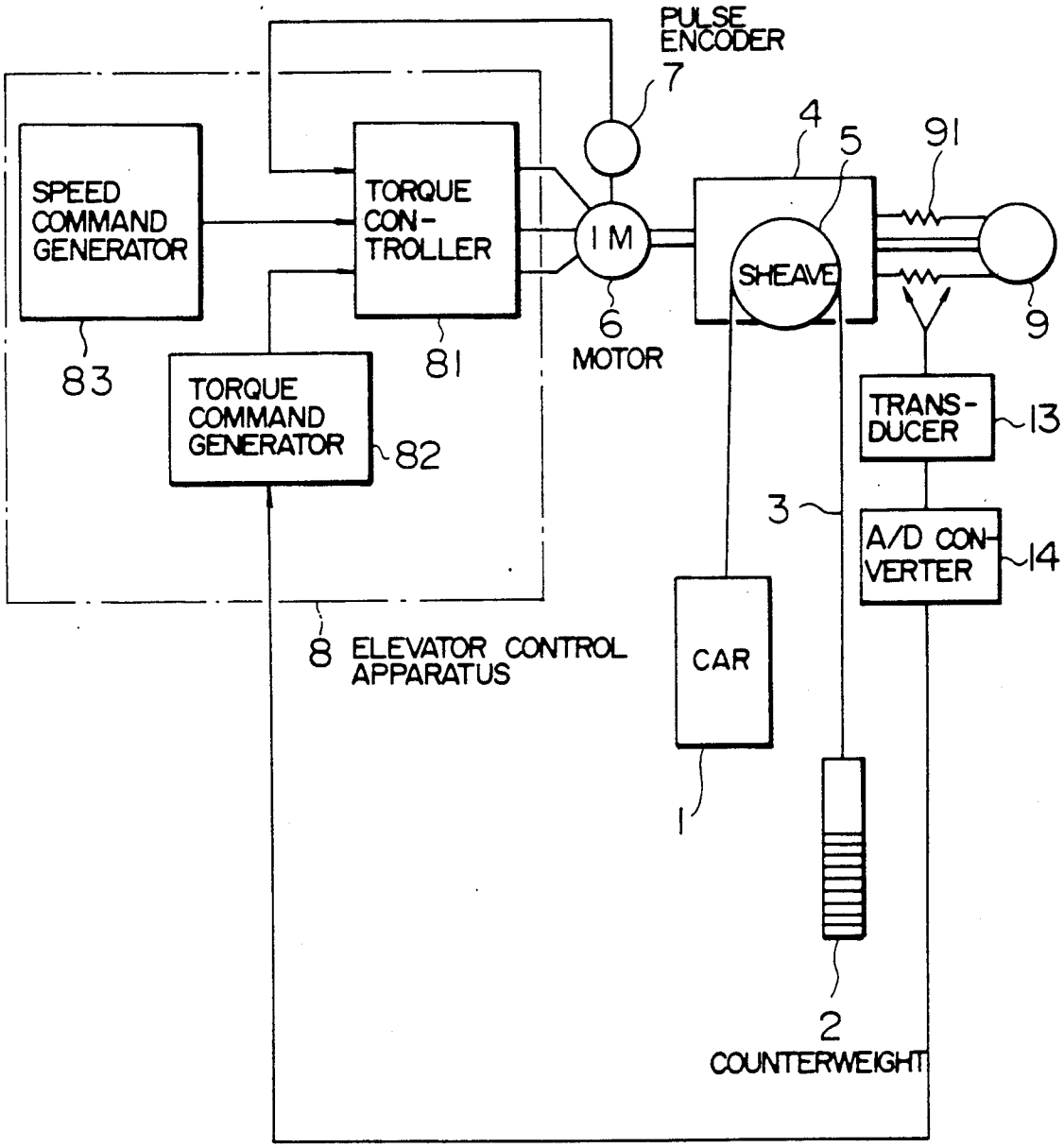
FIG. 7 is a schematic diagram showing a general arrangement of an elevator system provided with the control apparatus according to a third embodiment of the invention.

FIG. 7 shows a third embodiment of the present invention which differs from the first embodiment in that a transducer 13 is provided for converting the deformation of the elastic members 91 supporting resiliently the brake apparatus 9 into an electric signal in proportion to magnitude of the deformation, wherein the analogue output of the transducer 13 is supplied to an analogue-to-digital (A/D) converter 14, the-digital output of which is then supplied to the torque command generating unit 82 constituted by a microcomputer. With this arrangement, the start compensation is realized through a feedback control such that the output of the transducer 13 becomes zero. Thus, this embodiment can be implemented without need for the micro-switches and others.

In the foregoing, three main embodiments of the present invention have been described. In each of these embodiments, there may be adopted a car-onboard load detecting method described below.

First, in the state where the unbalance torque of the elevator is in balance with the motor torque after the start compensation, the car-onboard load can that time. In general, the counterweight of the elevator is so selected that the following condition can be satisfied:

$$Counterweight = Car\ Tare\ Weight + Rated\ Load \times \tfrac{1}{2}$$

Since the electric motor is commonly so designed that the rated motor torque is demanded when the car runs upwardly with the rated load, the car-onboard load can be estimated in accordance with the following expression:

$$\text{Car-Onboard Load} = \frac{|\text{Torque Command}|}{(\text{Torque Command For Up-Running With Rated Load})} \pm \frac{\text{Rated Load}}{2}$$

where the sign + (plus) presents the torque command of the up direction and the sign—(minus) represents the torque command of the down direction.

In this manner, the car-onboard load can be arithmetically determined at the start of the elevator operation. This information of the car-onboard load can be made use of for various purposes without need for installing a load detector beneath the car. By way of example, a false call issued mischievously within the car can be automatically cancelled after stop on the basis of the car-onboard load information. Further, this information may be utilized for realizing a car-full transit (pass) function, lighting a car-full indicator lamp and/or assignment of hall calls to cars of smaller onboard loads in a group-controlled elevator system where a plurality of cars are controlled systematically.

In conjunction with the elevator system shown in FIG. 1, it should be added that the teaching of the invention is applied not only to the start compensation but also to an emergency operation. To this end, an emergency DC supply source 15 is provided to serve for supplying electric energy upon occurrence of service interruption in the commercial power supply, wherein the emergency DC power source 15 is connected to the elevator control apparatus 8 through an inverter circuit 16 for converting the DC power to a power of voltage and frequency similar to those of the commercial power supply source. Usually, such emergency power supply source is of a necessary minimum capacity and can afford to operate the car only in the direction determined by that of the unbalance torque. In case the car stops between the adjacent landing floors upon occurrence of the service interruption, then the micro-switch 10 or 11 is closed in dependence on the direction of the unbalance torque, as described hereinbefore, whereby the car can automatically be moved in the direction determined by the micro-switch as closed toward the nearest landing floor in the emergency operation mode.

By virtue of the arrangement described just above, the direction of the unbalance torque can be detected without resorting to use of the conventional 50%-load detecting device installed beneath the car, whereby reduction in the cost can be accomplished.

It should be added that the present invention can equally be applied to a winding drum type elevator system as well as hydraulically operated elevator system.

As will now be appreciated from the foregoinq description, the start compensation of the elevator system can be accomplished with the control apparatus of much simplified structure.

We claim:

1. In an elevator system which includes an elevator driving electric motor, a sheave driven by said electric motor, a car and a counterweight suspended on said sheave by a rope in a well-rope like fashion, and brake means for holding stationarily the elevator dynamic system including the abovementioned components, said brake means being so installed on a structural member of a machine house as to be capable of displacement under an unbalance torque produced due to unbalance in weight between said car and said counterweight, an elevator control apparatus, comprising:

means for causing said electric motor to generate a torque increasing progressively in a direction to cancel out said displacement in the operating state of said brake means; and means for inhibiting said torque generated by said electric motor from further increasing in response to diminishment of said displacement within a predetermined range which lies within a permissible landing range of said car.

2. An elevator control apparatus according to claim 1, further including elastic means provided between said structural member and said brake means.

3. An elevator control apparatus according to claim 1, further including a plurality of micro-switches as means for detecting said displacement.

4. An elevator control apparatus according to claim 1, further comprising torque command means for commanding generation of torque by said electric motor, wherein said torque command means is so arranged as to hold a torque command value attained at the time point when said displacement has been diminished within said predetermined range.

5. An elevator control apparatus according to claim 4, wherein said brake means is allowed to be released after said torque value has been held.

6. In an elevator system which includes an elevator driving electric motor, a sheave driven by said electric motor, a car and a counterweight suspended on said sheave by a rope in a well-rope like fashion, and brake means for holding stationarily the elevator dynamic system including the abovementioned components, said brake means being so installed on a structural member of a machine house as to be capable of displacement under an unbalance torque produced due to unbalance in weight between said car and said counterweight, an elevator control apparatus, comprising:

means for causing said electric motor to generate a torque increasing progressively in a direction to cancel out said displacement in the operating state of said brake means; and means for inhibiting said torque generated by said electric motor from further increasing in response to diminishment of said displacement within a predetermined range;

further including a pulse generator coupled operatively to a shaft of said electric motor or a shaft of said brake means as means for detecting said displacement.

7. An elevator control apparatus according to claim 6, further including means for releasing said brake means in response to diminishment of said displacement within said predetermined range.

8. In an elevator system which includes an elevator driving electric motor, a sheave driven by said electric motor, a car and a counterweight suspended on said sheave by a rope in a well-rope like fashion, and brake means for holding stationarily the elevator dynamic system including the abovementioned components, said brake means being so installed on a structural member of a machine house as to be capable of displacement under an unbalance torque produced due to unbalance in weight between said car and said counterweight, an elevator control apparatus, comprising:

means for causing said electric motor to generate a torque increasing progressively in a direction to cancel out said displacement in the operating state of said brake means; and means for inhibiting said torque generated by said electric motor from further increasing in response to diminishment of said displacement within a predetermined range, means for releasing said brake means in response to diminishment of said displacement within said predetermined range, wherein said predetermined range for displacement lies within a permissible landing range of said car.

9. An elevator control apparatus according to claim 8, wherein said brake releasing means is so arranged as to be put into operation after lapse of a time duration which is set longer than a time taken for said displacement to be diminished within said predetermined range from a time point when an elevator start command is issued.

10. In an elevator system which includes an elevator driving electric motor, a sheave driven by said electric motor, a car and a counterweight suspended on said sheave by a rope in a well-rope like fashion, and brake means for holding stationarily the elevator dynamic system including the abovementioned components, said brake means being so installed on a structural member of a machine house as to be capable of displacement under an unbalance torque produced due to unbalance in weight between said car and said counterweight, an elevator control apparatus, comprising:

a pair of switch means capable of responding to predetermined displacements of said brake means in both rotational directions, respectively;

means for responding to actuation of one of said paired switch means to thereby increase progressively the torque generated by said electric motor in the direction corresponding to said one switch means;

means for holding the torque generated by said electric motor at a constant value in response to resetting of said one switch means to the inoperative state;

means for releasing said brake means in response to the resetting of said switch means; and means for generating a torque command for operation of the elevator car around a time point at which said brake means is released.

11. In an elevator system which includes an elevator driving electric motor, a sheave driven by said electric motor, a car and a counterweight suspended on said sheave by a rope in a well-rope like fashion, and brake means for holding stationarily the elevator dynamic system including the abovementioned components, said brake means being so installed on a structural member of a machine house as to be capable of displacement under an unbalance torque produced due to unbalance in weight between said car and said counterweight, an elevator control apparatus, comprising:

pulse generating means capable of responding to rotation of a shaft of said electric motor or a shaft of said brake means;

counter means for counting pulses outputted from said pulse generating means;

memory means for storing content of said counter means at a time point when said elevator car is about to stop after a given cycle of operation and before said brake means is actuated;

means for increasing progressively torque generated by said electric motor in a direction corresponding to the direction in which the content of said counter means is changed in response to actuation of said brake means;

means for holding the torque generated by said electric motor at a constant value in response to detection of a predetermined relation established between the content of said counter means and that of said memory means;

means for releasing said brake means in response to detection of the predetermined relation established between the content of said counter means and that of said memory means; and means for generating a torque command for elevator operation around a time point when said brake means is released.

12. An elevator control apparatus according to claim 11, further including means for detecting the direction of displacement of said car due to unbalance torque produced by said car and said counterweight in the state where said car is stopped before occurrence of service interruption and means for operating said car at a low speed in said detected direction upon occurrence of the service interruption.

13. An elevator control apparatus according to claim 12, wherein said means for operating said car at a low speed includes a power supply source for emergency.

14. In an elevator system which includes an elevator driving electric motor, a sheave driven by said electric motor, a car and a counterweight suspended on said sheave by a rope in a well-rope like fashion, and brake means for holding stationarily the elevator dynamic system including the abovementioned components, said brake means being so installed on a structural member of a machine house as to be capable of displacement under an unbalance torque produced due to unbalance in weight between said car and said counterweight, an elevator control apparatus, comprising:

a pair of switch means capable of responding to predetermined displacements of said brake means in both rotational directions, respectively;

means for responding to actuation of one of said paired switch means to thereby increase progressively the torque generated by said electric motor in the direction corresponding to said one switch means;

means for holding the torque generated by said electric motor at a constant value in response to resetting of said one switch means to the inoperative state;

means for releasing said brake means in response to the resetting of said switch means; and means for generating a torque command for operation of the elevator car around a time point at which said brake means is released;

further including means for detecting the direction of displacement of said car due to unbalance torque produced by said car and said counterweight in the state where said car is stopped before occurrence of service interruption and means for operating said car at a low speed in said detected direction upon occurrence of the service interruption.

15. An elevator control apparatus according to claim 14, wherein said means for operating said car at a low speed includes a power supply source for emergency.

16. In an elevator system including an elevator driving electric motor, a sheave driven by said electric motor, an elevator car and a counterweight suspended on said sheave by means of a rope in a well-rope like fashion, and a brake apparatus for holding stationarily the elevator dynamic system including the components mentioned above, an elevator control apparatus, comprising:

torque direction detecting means for detecting the direction of torque applied to said brake means in the state where said brake means is actuated;

torque increasing means for increasing progressively torque produced by said electric motor in the direction dependent on the output of said torque direction detecting means; and means for holding the torque generated by said electric motor at a predetermined value upon disappearance of the output of said torque direction detecting means.

17. An elevator control apparatus according to claim 16, further including means for releasing said brake means in response to the disappearance of the output of said torque direction detecting means.

18. An elevator control apparatus according to claim 17, further including means for producing an elevator speed command in response to the disappearance of the output of said torque direction detecting means.

19. An elevator control apparatus according to claim 17, wherein said brake releasing means is so arranged as to be put into operation after lapse of a tie duration which is set longer than a time taken for said displacement to be diminished within a predetermined time from a point when an elevator start command is issued.

20. An elevator control apparatus according to claim 16, further including means for producing an elevator speed command in response to the disappearance of the output of said torque direction detecting means.

21. An elevator control apparatus according to claim 16, further including elastic means provided between said structural member and said brake means.

22. An elevator control apparatus according to claim 16, further including a pulse generator coupled operatively to a shaft of said electric motor or a shaft of said brake means as means for detecting said direction of torque.

23. In an elevator system which includes an elevator driving electric motor, a sheave driven by said electric motor, a car and a counterweight suspended on said sheave by a rope in a well-rope like fashion, and brake means for holding stationarily the elevator dynamic system including the abovementioned components, said brake means being so installed on a structural member of a machine house as to be capable of displacement under an unbalance torque produced due to unbalance in weight between said car and said counterweight, an elevator control apparatus, comprising:

pulse generating means capable of responding to rotation of a shaft of said electric motor or a shaft of said brake means;

counter means for counting pulses outputted from said pulse generating means;

memory means for storing content of said counter means at a time point when said elevator car is about to stop after a given cycle of operation and before said brake means is actuated;

means for increasing progressively torque generated by said electric motor in a direction corresponding to the direction in which the content of said counter means is changed in response to actuation of said brake means; and means for holding the torque generated by said electric motor at a constant value in response to detection of a predetermined relation established between the content of said counter means and that of said memory means.

24. An elevator control apparatus according to claim 23, further including means for detecting the direction of displacement of said car due to unbalance torque produced by said car and said counterweight in the state where said car is stopped before occurrence of service interruption and means for operating said car at a low speed in said detected direction upon occurrence of the service interruption.

25. An elevator control apparatus according to claim 24, wherein said means for operating said car at a low speed includes a power supply source for emergency.

26. An elevator control apparatus according to claim 23, wherein said predetermined range for said displacement lies within a permissible landing range of said car.

27. An elevator control apparatus according to claim 23, further including elastic means provided between said structural member and said brake means.

28. An elevator control apparatus according to claim 23, further including a pulse generator coupled operatively to a shaft of said electric motor or a shaft of said brake means as means for detecting said direction of torque.

29. An elevator control apparatus according to claim 23, wherein said brake releasing means is so arranged as to be put into operation after lapse of a time duration which is set longer than a time taken for said displacement to be diminished within a predetermined time from a time point when an elevator start command is issued.

30. An elevator control apparatus according to claim 23, further including means for releasing said brake means in response to detection of the predetermined relation established between the content of said counter means and that of said memory means.

31. An elevator control apparatus according to claim 30, wherein said predetermined range for said displacement lies within a permissible landing range of said car.

32. An elevator control apparatus according to claim 30, further including elastic means provided between said structural member and said brake means.

33. An elevator control apparatus according to claim 30, further including a pulse generator coupled operatively to a shaft of said electric motor or a shaft of said brake means as means for detecting said direction of torque.

34. An elevator control apparatus according to claim 30, wherein said brake releasing means is so arranged as to be put into operation after lapse of a time duration which is set longer than a time taken for said displacement to be diminished within a predetermined time from a time point when an elevator start command is issued.

* * * * *